US007562013B2

(12) United States Patent
Gotanda et al.

(10) Patent No.: US 7,562,013 B2
(45) Date of Patent: Jul. 14, 2009

(54) METHOD FOR RECOVERING TARGET SPEECH BASED ON AMPLITUDE DISTRIBUTIONS OF SEPARATED SIGNALS

(75) Inventors: Hiromu Gotanda, Fukuoka (JP); Keiichi Kaneda, Fukuoka (JP); Takeshi Koya, Fukuoka (JP)

(73) Assignee: Kitakyushu Foundation For The Advancement of Industry, Science and Technology (JP)

( * ) Notice: Subject to any disclaimer, the term of this patent is extended or adjusted under 35 U.S.C. 154(b) by 662 days.

(21) Appl. No.: 10/572,427

(22) PCT Filed: Aug. 31, 2004

(86) PCT No.: PCT/JP2004/012898

§ 371 (c)(1),
(2), (4) Date: Mar. 17, 2006

(87) PCT Pub. No.: WO2005/029467

PCT Pub. Date: Mar. 31, 2005

(65) Prior Publication Data

US 2007/0100615 A1 May 3, 2007

(30) Foreign Application Priority Data

Sep. 17, 2003 (JP) ..... 2003-324733

(51) Int. Cl.
*G10L 21/02* (2006.01)

(52) U.S. Cl. ..... 704/228; 704/233; 704/226; 381/94.2; 381/94.3

(58) Field of Classification Search ..... 704/233, 704/226, 228; 381/94.2, 94.3
See application file for complete search history.

(56) References Cited

FOREIGN PATENT DOCUMENTS

JP 2002-023776 1/2002

OTHER PUBLICATIONS

A. Cichocki and S. Amari, "Adaptive Blind Signal and Image Processing: Learning Algorithms and Applications", 1st Edition, 2002, John Wiley & Sons, Ltd, pp. 128-175.

(Continued)

*Primary Examiner*—Daniel Abebe
(74) *Attorney, Agent, or Firm*—Pepper Hamilton LLP.

(57) ABSTRACT

The present invention provides a method for recovering target speech based on shapes of amplitude distributions of split spectra obtained by use of blind signal separation. This method includes: a first step of receiving target speech emitted from a sound source and a noise emitted from another sound source and forming mixed signals of the target speech and the noise at a first microphone and at a second microphone; a second step of performing the Fourier transform of the mixed signals from the time domain to the frequency domain, decomposing the mixed signals into two separated signals $U_1$ and $U_2$ by use of the Independent Component Analysis, and, based on transmission path characteristics of the four different paths from the two sound sources to the first and second microphones, generating the split spectra $v_{11}$, $v_{12}$, $v_{21}$ and $v_{22}$ from the separated signals $U_1$ and $U_2$; and a third step of extracting estimated spectra Z* corresponding to the target speech to generate a recovered spectrum group of the target speech, wherein the split spectra $v_{11}$, $v_{12}$, $v_{21}$, and $v_{22}$ are analyzed by applying criteria based on the shape of the amplitude distribution of each of the split spectra $v_{11}$, $v_{12}$, $v_{21}$, and $v_{22}$, and performing the inverse Fourier transform of the recovered spectrum group from the frequency domain to the time domain to recover the target speech.

5 Claims, 3 Drawing Sheets

OTHER PUBLICATIONS

A. Hyvarinen and E. Oja, "Independent Component Analysis: Algorithms and Applications", Neural Networks Research Centre, Helsinki University of Technology, Pergamon Press, Jun. 2000, vol. 13, No. 4-5, pp. 1-31.

N. Murata et al., "An Approach to Blind Source Separation Based on Temporal Structure of Speech Signals", Neurocomputing, Oct. 2001, vol. 41, Elsevier Science B.V., pp. 1-24.

E. Bingham and A. Hyvarinen, "A Fast Fixed-Point Algorithm for Independent Component Analysis of Complex Valued Signals", International Journal of Neural Systems, vol. 10, No. 1, Feb. 2000, World Scientific Publishing Company, pp. 1-8.

N. Gotanda et al., "Permutation Correction and Speech Extraction Based on Split Spectrum Through FastICA", $4^{th}$ International Symposium on Independent Component Analysis and Blind Signal Separation, Apr. 2003, Nara, Japan, pp. 379-384.

K. Nobu et al., "Noise Cancellation Based on Split Spectra by Using Sounds Location", Journal of Robotics and Mechanatronics vol. 15, No. 1, 2003, pp. 15-23.

METHOD FOR RECOVERING TARGET SPEECH BASED ON AMPLITUDE DISTRIBUTIONS OF SEPARATED SIGNALS

CROSS REFERENCE TO RELATED APPLICATIONS

This application is the U.S. national phase of PCT/JP2004/012898, filed Aug. 31, 2004, which claims priority under 35 U.S.C. 119 to Japanese Patent Application No. 2003-324733, filed on Sep. 17, 2003. The entire disclosure of the aforesaid application is incorporated herein by reference.

BACKGROUND OF THE INVENTION

1. Field of the Invention

The present invention relates to a method for recovering target speech by extracting estimated spectra of the target speech, while resolving permutation ambiguity based on shapes of amplitude distributions of split spectra that are obtained by use of the Independent Component Analysis (ICA).

2. Description of the Related Art

A number of methods for separating a noise from a speech signal have been proposed by using blind signal separation through the ICA. (See, for example, "*Adaptive Blind Signal and Image Processing*" by A. Cichoki and S. Amari, first edition, USA, John Wiley, 2002; and "*Independent Component Analysis: Algorithms and Applications*" by A. Hyvarinen and E. Oja, Neural Networks, USA, Pergamon Press, June 2000, Vol. 13, No. 4-5, pp. 411-430.) The frequency-domain ICA has an advantage of providing good convergence as compared to the time -domain ICA. However, in the frequency-domain ICA, problems associated with the ICA-specific scaling or permutation ambiguity exist at each frequency bin of the separated signals, and all these problems need to be resolved in the frequency domain.

Examples addressing the above issues include a method wherein the scaling problems are resolved by use of split spectra and the permutation problems are resolved by analyzing the envelop curve of a split spectrum series at each frequency. This is referred to as the envelop method. (See, for example, "*An Approach to Blind Source Separation based on Temporal Structure of Speech Signals*" by N. Murata, S, Ikeda, and A. Ziehe, Neurocomputing, USA, Elsevier, October 2001, Vol. 41, No. 1-4, pp. 1-24.)

However, the envelope method is often ineffective depending on sound collection conditions. Also, the correspondence between the separated signals and the sound sources (speech and a noise) is ambiguous in this method; therefore, it is difficult to identify which one of the resultant split spectra after permutation correction corresponds to the target speech or to the noise. For this reason, specific judgment criteria need to be defined in order to extract the estimated spectra for the target speech as well as for the noise from the split spectra.

SUMMARY OF THE INVENTION

In view of the above situations, the objective of the present invention is to provide a method for recovering target speech based on shapes of amplitude distributions of split spectra obtained by use of blind signal separation, wherein the target speech is recovered by extracting estimated spectra of the target speech while resolving permutation ambiguity of the split spectra obtained through the ICA. Here, blind signal separation means a technology for separating and recovering a target sound signal from mixed sound signals emitted from a plurality of sound sources.

According to the present invention, a method for recovering target speech based on shapes of amplitude distributions of split spectra obtained by use of blind signal separation comprises: a first step of receiving target speech emitted from a sound source and a noise emitted from another sound source and forming mixed signals of the target speech and the noise at a first microphone and at a second microphone, the microphones being provided at separate locations; a second step of performing the Fourier transform of the mixed signals from a time domain to a frequency domain, decomposing the mixed signals into two separated signals $U_1$ and $U_2$ by use of the Independent Component Analysis, and, based on transmission path characteristics of four different paths from the two sound sources to the first and second microphones, generating from the separated signal $U_1$ a pair of split spectra $v_{11}$ and $v_{12}$, which were received at the first and second microphones respectively, and from the separated signal $U_2$ another pair of split spectra $v_{21}$ and $v_{22}$, which were received at the first and second microphones respectively; and a third step of extracting estimated spectra Z* corresponding to the target speech and estimated spectra Z corresponding to the noise to generate a recovered spectrum group of the target speech from the estimated spectra Z*, wherein the split spectra $v_{11}$, $v_{12}$, $v_{21}$, and $v_{22}$ are analyzed by applying criteria based on the shape of the amplitude distribution of each of the split spectra $v_{11}$, $v_{12}$, $v_{21}$, and $v_{22}$, and performing the inverse Fourier transform of the recovered spectrum group from the frequency domain to the time domain to recover the target speech.

The target speech emitted from one sound source and the noise emitted from another sound source are received at the first and second microphones provided at separate locations. At each microphone, a mixed signal of the target speech and the noise is formed.

In general, speech and a noise are considered to be statistically independent. Therefore, a statistical method, such as the ICA, may be employed in order to decompose the mixed signals into two independent components, one of which corresponds to the target speech and the other corresponds to the noise. Note here that the mixed signals include convoluted sounds due to reflection and reverberation. Therefore, the Fourier transform of the mixed signals from the time domain to the frequency domain is performed so as to treat them just like in the case of instant mixing, and the frequency-domain ICA is employed to obtain the separated signals $U_1$ and $U_2$ corresponding to the target speech and the noise respectively.

Thereafter, by taking into account the four different transmission paths from the two sound sources to the first and second microphones, generated from the separated signal $U_1$ are a pair of split spectra $v_{11}$ and $v_{12}$, which were received at the first and second microphones respectively, and generated from the separated signal $U_2$ are another pair of split spectra $v_{21}$ and $v_{22}$, which were received at the first and second microphones respectively.

There is a well-known difference in statistical characteristics between speech and a noise in the time domain. That is, the shape of the amplitude distribution of a speech signal is close to that of the super Gaussian distribution, which is characterized by a relatively high kurtosis and a wide base, whereas the shape of the amplitude distribution of a noise signal has a relatively low kurtosis and a narrow base. This difference in shapes of amplitude distributions between a speech signal and a noise signal is considered to exist even after the Fourier transform. At each frequency, a plurality of components form a spectrum series according to the frame number used for discretization. It is thus expected that, at each frequency, the shape of the amplitude distribution of a split spectrum series of the target speech is close to that of the super Gaussian distribution, whereas the shape of the amplitude distribution of a split spectrum series corresponding to the noise has a relatively low kurtosis and a narrow base. Hereinafter, an amplitude distribution of a spectrum refers to an amplitude distribution of a spectrum series at each frequency.

Among the split spectra $v_{11}$, $V_{12}$, $v_{21}$, and $v_{22}$, the spectra $v_{11}$ and $v_{12}$ correspond to one sound source, and the spectra $v_{21}$ and $v_{22}$ correspond to the other sound source. Therefore, by first obtaining the amplitude distributions for $v_{11}$ and $v_{22}$ (or for $v_{12}$ and $v_{21}$) and then by examining the shape of the amplitude distribution of each of the two spectra, it is possible to assign the one which has an amplitude distribution close to the super Guassian to the estimated spectrum Z* corresponding to the target speech, and assign the other with a relatively low kurtosis and a narrow base to the estimated spectrum Z corresponding to the noise. Thereafter, the recovered spectrum group of the target speech can be generated from all the extracted estimated spectra Z*, and the target speech can be recovered by performing the inverse transform of the estimated spectra Z* back to the time domain.

According to the present invention, it is preferable that the shape of the amplitude distribution of each of the split spectra $v_{11}$, $v_{12}$, $v_{21}$, and $v_{22}$ is evaluated by means of entropy E of the amplitude distribution. Here, the amplitude distribution is related to a probability density function which shows the frequency of occurrence of a main amplitude value; thus, the shape of the amplitude distribution may be considered to represent uncertainty of the amplitude value. In order to quantitatively evaluate the shape of the amplitude distribution, entropy E may be employed. The entropy E is smaller when the amplitude distribution is close to the super Gaussian than when the amplitude distribution has a relatively low kurtosis and a narrow base. Therefore, the entropy for speech is small, and the entropy for a noise is large.

A kurtosis may be employed for a quantitative evaluation of the shape of the amplitude distribution. However, it is not preferable because its results are not robust in the presence of outliers. Statistically, a kurtosis is expressed with up to the fourth order moment. On the other hand, entropy is expressed as the weighted summation of all of the moments ($0^{th}$, $1^{st}$, $2^{nd}$, $3^{rd}$ · · · ) by the Taylor expansion. Therefore, entropy is a statistical measure that contains a kurtosis as its part.

According to the present invention, it is preferable that the entropy E is obtained by using the amplitude distribution of the real part of each of the split spectra $v_{11}$, $v_{12}$, $v_{21}$, and $v_{22}$. Since the amplitude distributions of the real part and the imaginary part of each of the split spectra $v_{11}$, $v_{12}$, $v_{21}$, and $v_{22}$ have the similar shape, the entropy E may be obtained by use of either one. It is preferable that the real part is used because the real part represents actual signal intensities of the speech or the noise in the split spectra.

According to the present invention, it is preferable that the entropy is obtained by using the variable waveform of the absolute value of each of the split spectra $v_{11}$, $v_{12}$, $v_{21}$, and $v_{22}$. When the variable waveform of the absolute value is used, the variable range is limited to positive values with 0 inclusive, thereby greatly reducing the calculation load for obtaining the entropy.

According to the present invention, it is preferable that the entropy E for the spectrum $v_{11}$, denoted as $E_{11}$, and the entropy E for the spectrum $v_{22}$, denoted as $E_{22}$, are obtained to calculate a difference $\Delta E = E_{11} - E_{22}$, and the criteria are given as:

(1) if the difference ΔE is negative, the split spectrum $v_{11}$ is extracted as the estimated spectrum Z*; and (2) if the difference ΔE is positive, the split spectrum $v_{21}$ is extracted as the estimated spectrum Z*.

Among the entropies obtained for the split spectra $v_{11}$, $v_{21}$, $v_{21}$, and $v_{22}$, the entropies $E_{11}$ and $E_{12}$ correspond to one sound source, and the entropies $E_{21}$ and $E_{22}$ correspond to the other sound source. Therefore, the entropies $E_{11}$ and $E_{12}$ are considered to be essentially equivalent, and the entropies $E_{21}$ and $E_{22}$ are considered to be essentially equivalent. Therefore, the entropy $E_{11}$ may be used as the entropy corresponding to the one sound source, and the entropy $E_{22}$ may be used as the entropy corresponding to the other sound source. After obtaining the entropies $E_{11}$ and $E_{22}$ for $v_{11}$ and $v_{22}$ respectively, it is possible to assign the small one to the target speech and the large one to the noise. As a result, $v_{11}$ can be assigned to the estimated spectrum Z* if the difference ΔE is negative, i.e. $E_{11} < E_{22}$, and $v_{21}$ is assigned to the estimated spectrum Z* if the difference ΔE is positive, i.e. $E_{11} > E_{22}$.

According to the present invention as described in claim 1-5, based on the shape of the amplitude distribution of each spectrum that is determined to correspond to one of the sound sources, the estimated spectra Z* and Z corresponding to the target speech and the noise are determined respectively. Therefore, it is possible to recover the target speech by extracting the estimated spectra of the target speech, while resolving permutation ambiguity without effects arising from transmission paths or sound collection conditions. As a result, input operations by means of speech recognition in a noisy environment, such as voice commands or input for OA, for storage management in logistics, and for operating car navigation systems, may be able to replace the conventional input operations by use of fingers, touch censors or keyboards.

According to the present invention as described in claim 2, it is possible to accurately evaluate the shape of the amplitude distribution of each of the split spectra even if the spectra contain outliers. Therefore, it is possible to extract the estimated spectra Z* and Z corresponding to the target speech and the noise respectively even in the presence of outliers.

According to the present invention as described in claim 3, it is possible to directly and quickly extract the spectra to recover the target speech because the entropy is obtained for the actual signal intensities of the speech or the noise.

According to the present invention as described in claim 4, it is possible to quickly obtain the entropy because the calculation load is greatly reduced.

According to the present invention as described in claim 5, it is possible to assign the entropy $E_{11}$ obtained for $v_{11}$ to one sound source and the entropy $E_{22}$ obtained for $v_{22}$ to the other sound source, thereby making it possible to accurately and quickly extract the estimated spectrum Z* corresponding to the target speech with the small calculation load. As a result, it is possible to provide a speech recognition engine with a fast response time of speech recovery under real-life conditions, and at the same time, with extremely high recognition capability.

DETAILED DESCRIPTION OF THE PREFERRED EMBODIMENTS

Embodiments of the present invention are described below with reference to the accompanying drawings to facilitate understanding of the present invention.

Figure 1:
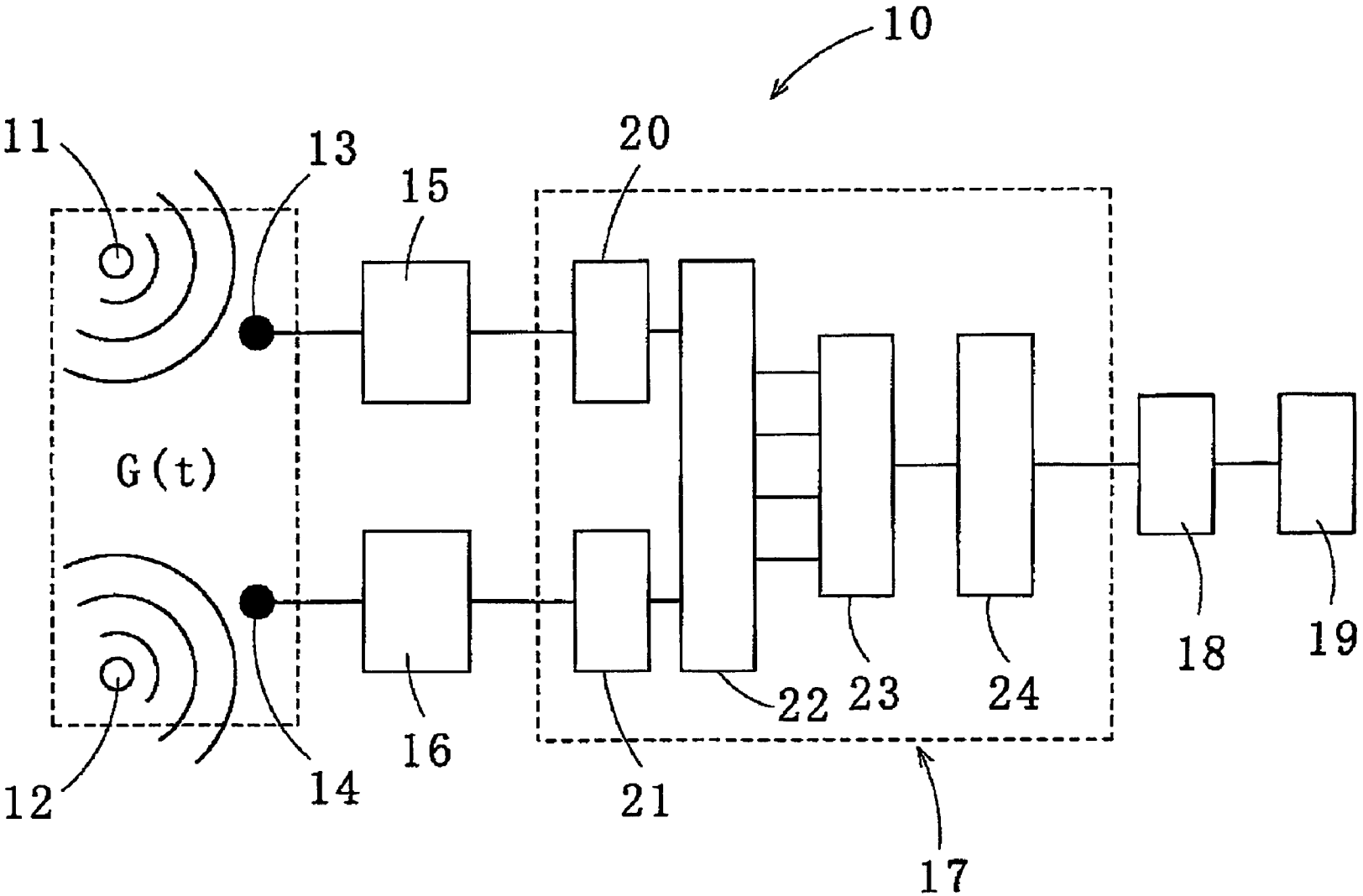
FIG. 1 is a block diagram showing a target speech recovering apparatus employing the method for recovering target speech based on shapes of amplitude distributions of split spectra obtained by use of blind signal separation according to one embodiment of the present invention.

As shown in FIG. 1, a target speech recovering apparatus 10, which employs a method for recovering target speech based on shapes of amplitude distributions of split spectra obtained through blind signal separation according to one embodiment of the present invention, comprises two sound sources 11 and 12 (one of which is a target speech source and the other is a noise source, although they are not identified), a first microphone 13 and a second microphone 14, which are provided at separate locations for receiving mixed signals transmitted from the two sound sources, a first amplifier 15 and a second amplifier 16 for amplifying the mixed signals received at the microphones 13 and 14 respectively, a recovering apparatus body 17 for separating the target speech and the noise from the mixed signals entered through the amplifiers 15 and 16 and outputting recovered signals of the target speech and the noise, a recovered signal amplifier 18 for amplifying the recovered signals outputted from the recovering apparatus body 17, and a loudspeaker 19 for outputting the amplified recovered signals. These elements are described in detail below.

For the first and second microphones 13 and 14, microphones with a frequency range wide enough to receive signals over the audible range (10-20000 Hz) may be used. Here, there is no restriction on the relative locations between the first microphone and the sound sources 11 and 12 and between the second microphone and the sound sources 11 and 12.

For the amplifiers 15 and 16, amplifiers with frequency band characteristics that allow non-distorted amplification of audible signals may be used.

The recovering apparatus body 17 comprises A/D converters 20 and 21 for digitizing the mixed signals entered through the amplifiers 15 and 16, respectively.

The recovering apparatus body 17 further comprises a split spectra generating apparatus 22, equipped with a signal separating arithmetic circuit and a spectrum splitting arithmetic circuit. The signal separating arithmetic circuit performs the Fourier transform of the digitized mixed signals from the time domain to the frequency domain, and decomposes the mixed signals into two separated signals $U_1$ and $U_2$ by means of the Fast ICA. Based on transmission path characteristics of the four possible paths from the two sound sources 11 and 12 to the first and second microphones 13 and 14, the spectrum splitting arithmetic circuit generates from the separated signal $U_1$ one pair of split spectra $v_{11}$ and $v_{12}$ which were received at the first microphone 13 and the second microphone 14 respectively, and generates from the separated signal $U_2$ another pair of split spectra $v_{21}$ and $v_{22}$ which were received at the first microphone 13 and the second microphone 14 respectively.

The recovering apparatus body 17 further comprises: a recovered spectra extracting circuit 23 for extracting estimated spectra Z* corresponding to the target speech and estimated spectra Z corresponding to the noise to generate and output a recovered spectrum group of the target speech from the estimated spectra Z*, wherein the split spectra $v_{11}$, $v_{12}$, $v_{21}$, and $v_{22}$ generated by the split spectra generating apparatus 22 are analyzed by applying criteria based on the shape of the amplitude distribution of each of $v_{11}$, $v_{12}$, $v_{21}$, and $v_{22}$ which depend on the transmission path characteristics of the four different paths from the two sound sources 11 and 12 to the first and second microphones 13 and 14; and a recovered signal generating circuit 24 for performing the inverse Fourier transform of the recovered spectrum group from the frequency domain to the time domain to generate the recovered signal.

The split spectra generating apparatus 22, equipped with the signal separating arithmetic circuit and the spectrum splitting arithmetic circuit, the recovered spectra extracting circuit 23, and the recovered signal generating circuit 24 may be structured by loading programs for executing each circuit's functions on, for example, a personal computer. Also, it is possible to load the programs on a plurality of microcomputers and form a circuit for collective operation of these microcomputers.

In particular, if the programs are loaded on a personal computer, the entire recovering apparatus body 17 may be structured by incorporating the A/D converters 20 and 21 into the personal computer.

For the recovered signal amplifier 18, an amplifier that allows analog conversion and non-distorted amplification of audible signals may be used. A loudspeaker that allows non-distorted output of audible signals may be used for the loudspeaker 19.

Figure 2:
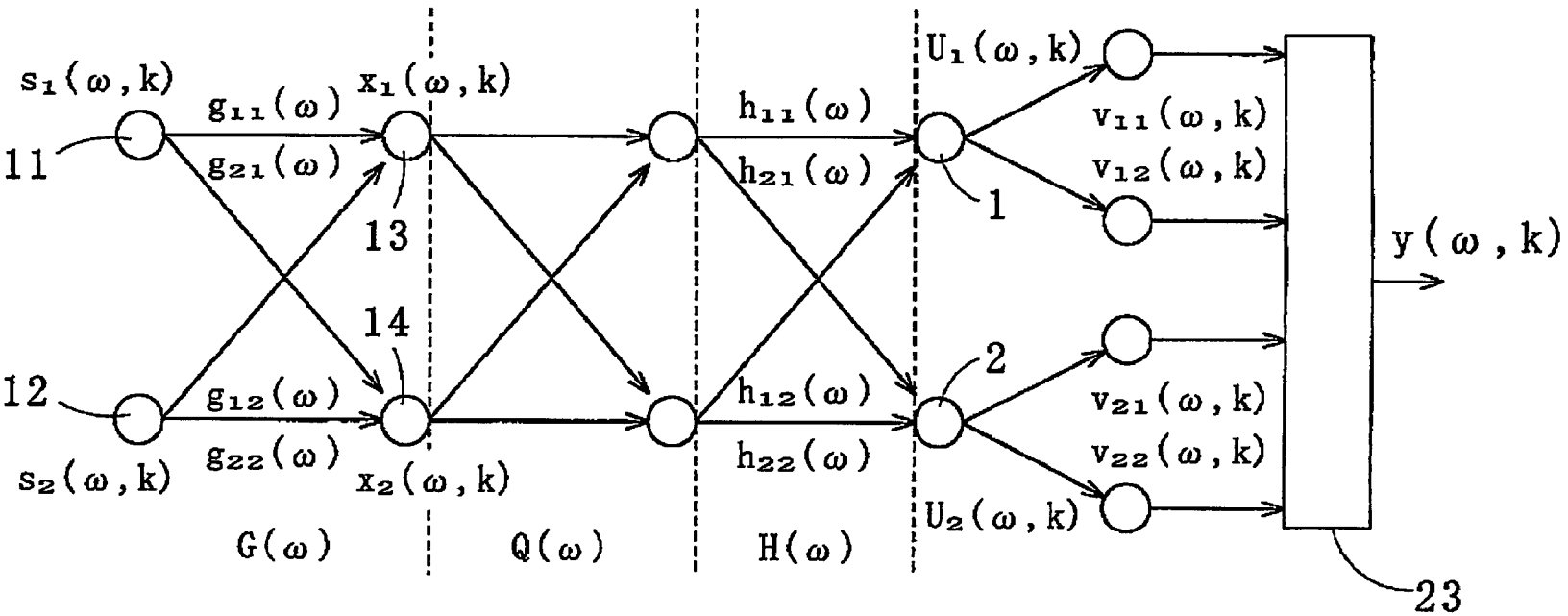
FIG. 2 is an explanatory view showing a signal flow in which a recovered spectrum is generated from the target speech and the noise per the method in FIG. 1.

As shown in FIG. 2, the method for recovering target speech based on the shape of the amplitude distribution of each of the split spectra obtained through blind signal separation according to one embodiment of the present invention comprises: the first step of receiving a signal $s_1(t)$ from the sound source 11 and a signal $s_2(t)$ from the sound source 12 at the first and second microphones 13 and 14 and forming mixed signals $x_1(t)$ and $x_2(t)$ at the first microphone 13 and at the second microphone 14 respectively; the second step of performing the Fourier transform of the mixed signals $x_1(t)$ and $x_2(t)$ from the time domain to the frequency domain, decomposing the mixed signals into two separated signals $U_1$ and $U_2$ by means of the Independent Component Analysis, and, based on the transmission path characteristics of the four possible paths from the sound sources 11 and 12 to the first and second microphones 13 and 14, generating from the separated signal $U_1$ one pair of split spectra $v_{11}$ and $v_{12}$, which were received at the first microphone 13 and the second microphone 14 respectively, and from the separated signal $U_2$ another pair of split spectra $v_{21}$ and $v_{22}$, which were received at the first microphone 13 and the second microphone 14 respectively; and the third step of extracting the estimated spectra Z* corresponding to the target speech and the estimated spectra Z corresponding to the noise to generate and output the recovered spectrum group of the target speech from t he estimated spectra Z*, wherein the split spectra $v_{11}$, $v_{12}$, $v_{21}$, and $v_{22}$ are analyzed by applying criteria based on the shape of the amplitude distribution of each of $v_{11}$, $v_{12}$, $v_{21}$, and $v_{22}$, and performing the inverse Fourier transform of the recovered spectrum group from the frequency domain to the time domain to generate the recovered signal of the target speech. The above steps are described in detail below. "t" represents ,time, throughout.

1. First Step

In general, the signal $s_1(t)$ from the sound source 11 and the signal $s_2(t)$ from the sound source 12 are assumed to be statistically independent of each other. The mixed signals $x_1(t)$ and $x_2(t)$, which are obtained by receiving the signals $s_1(t)$ and $s_2(t)$ at the microphones 13 and 14 respectively, are expressed as in Equation (1):

$$x(t)=G(t)*s(t) \tag{1}$$

where $s(t)=[s_1(t), s_2(t)]^T$, $x(t)=[x_1(t), x_2(t)]^T$, * is a convolution operator, and G(t) represents temper functions from the sound sources 11 and 12 to the first and second microphones 13 and 14.

2. Second Step

As in Equation (1), when the signals from the sound sources 11 and 12 are convoluted, it is difficult to separate the signals $s_1(t)$ and $s_2(t)$ from the mixed signals $x_1(t)$ and $x_2(t)$ in the time domain Therefore, the mixed signals $x_1(t)$ and $x_2(t)$ are divided into short time intervals (frames) and are transformed from the time domain to the frequency domain for each frame as in Equation (2):

$$x_j(\omega, k) = \sum_t e^{-\sqrt{-1}\,\omega t} x_j(t) w(t - k\tau) \tag{2}$$

$$(j = 1, 2; k = 0, 1, \ldots, K-1)$$

where ω (=0, 2π/M, . . . , 2π(M−1)/M) is a normalized frequency, M is the number of sampling in a frame, w(t) is a window function, τ is a frame interval, and K is the number of frames. For example, the time interval can be about several 10 msec. In this way, it is also possible to treat the spectra as a group of spectrum series by laying out the components at each frequency in the order of frames.

In this case, mixed signal spectra x(ω,k) and corresponding spectra of the signals $s_1(t)$ and $s_2(t)$ are related to each other in the frequency domain as in Equation (3):

$$x(\omega, k)=G(\omega)s(\omega, k) \tag{3}$$

where s(ω,k) is the discrete Fourier transform of a windowed s(t), and G(ω) is a complex number matrix that is the discrete Fourier transform of G(t).

Since the signal spectrum $s_1(\omega,k)$ and the signal spectrum $s_2(\omega,k)$ are inherently independent of each other, if mutually independent separated signal spectra $U_1(\omega,k)$ and $U_2(\omega,k)$ are calculated from the mixed signal spectra x(ω,k) by use of the Fast ICA, these separated spectra will correspond to the signal spectrum $s_1(\omega,k)$ and the signal spectrum $s_2(\omega,k)$ respectively. In other words, by obtaining a separation matrix H(ω)Q(ω) with which the relationship expressed in Equation (4) is valid between the mixed signal spectra x(ω,k) and the separated signal spectra $U_1(\omega,k)$ and $U_2(\omega,k)$, it becomes possible to determine the mutually independent separated signal spectra $U_1(\omega,k)$ and $U_2(\omega,k)$ from the mixed signal spectra x(ω,k).

$$U(\omega, k)=H(\omega)Q(\omega)\times(\omega) \tag{4}$$

where $u(\omega,k)=[U_1(\omega,k),U_2(\omega,k)]^T$.

Incidentally, in the frequency domain, amplitude ambiguity and permutation occur at individual frequencies as in Equation (5):

$$H(\omega)Q(\omega)G(\omega)=PD(\omega) \tag{5}$$

where H(ω) is defined later in Equation (10), Q(ω) is a whitening matrix, P is a matrix representing permutation with only one element in each row and each column being 1 and all the other elements being 0, and $D(\omega)=\mathrm{diag}[d_1(\omega),d_2(\omega)]$ is a diagonal matrix representing the amplitude ambiguity. Therefore, these problems need to be addressed in order to obtain meaningful separated signals for recovering.

In the frequency domain, on the assumption that its real and imaginary parts have the mean 0 and the sane variance and are uncorrelated, each sound source spectrum $s_1(\omega,k)$ (i=1,2) is formulated as follows.

First, at a frequency ω, a separation weight $h_n(\omega)$ (n=1,2) is obtained according to the FastICA algorithm, which is a modification of the Independent Component Analysis algorithm, as shown in Equations (6) and (7):

$$h_n^+(\omega) = \frac{1}{K}\sum_{k=0}^{K-1}\{x(\omega, k)\overline{u}_n(\omega, k)f(|u_n(\omega, k)|^2) - [f(|u_n(\omega, k)|^2) + |u_n(\omega, k)|^2 f'(|u_n(\omega, k)|^2)]h_n(\omega)\} \tag{6}$$

$$h_n(\omega) = h_n^+(\omega)/\|h_n^+(\omega)\| \tag{7}$$

where $f(|u_n(\omega,k)|^2)$ is a nonlinear function, and $f(|u_n(\omega,k)|^2)$ is the derivative of $f(|u_n(\omega,k)|^2)$, is a conjugate sign, and K is the number of frames.

This algorithm is repeated until a convergence condition CC shown in Equation (8):

$$CC=h_n^{-T}(\omega)h_n^{+}(\omega)\approx 1 \tag{8}$$

is satisfied (for example, CC becomes greater than or equal to 0.9999). Further, $h_2(\omega)$ is orthogonalized with $h_1(\omega)$ as in Equation (9):

$$h_2(\omega)=h_2(\omega)-h_1(\omega)h_1^{-T}(\omega)h_2(\omega) \tag{9}$$

and normalized as in Equation (7) again.

The aforesaid FastICA algorithm is carried out for each frequency ω. The obtained separation weights $h_n(\omega)$ (n=1,2) determine H(ω) as in Equation (10):

$$H(\omega) = \begin{bmatrix} \overline{h}_1^T(\omega) \\ \overline{h}_2^T(\omega) \end{bmatrix} \tag{10}$$

which is used in Equation (4) to calculate the separated signal spectra $u(\omega,k)=[U_1(\omega,k),U_2(\omega,k)]^T$ at each frequency. As shown in FIG. 2, two nodes where the separated signal spectra $U_1(\omega,k)$ and $U_2(\omega,k)$ are outputted are referred to as 1 and 2.

The split spectra $v_1(\omega,k)=[v_{11}(\omega,k),v_{12}(\omega,k)]^T$ and $v_2(\omega,k)=[v_{21}(\omega,k),v_{22}(\omega,k)]^T$ are defined as spectra generated as a pair (1 and 2) at nodes n (=1, 2) from the separated signal spectra $U_1(\omega,k)$ and $U_2(\omega,k)$ respectively, as shown in Equations (11) and (12):

$$\begin{bmatrix} v_{11}(\omega, k) \\ v_{12}(\omega, k) \end{bmatrix} = (H(\omega)Q(\omega))^{-1}\begin{bmatrix} U_1(\omega, k) \\ 0 \end{bmatrix} \tag{11}$$

$$\begin{bmatrix} v_{21}(\omega, k) \\ v_{22}(\omega, k) \end{bmatrix} = (H(\omega)Q(\omega))^{-1}\begin{bmatrix} 0 \\ U_2(\omega, k) \end{bmatrix} \tag{12}$$

If the permutation is not occurring but the amplitude ambiguity exists, the separated signal spectra $U_n(\omega,k)$ are outputted as in Equation (13):

$$\begin{bmatrix} U_1(\omega, k) \\ U_2(\omega, k) \end{bmatrix} = \begin{bmatrix} d_1(\omega)s_1(\omega, k) \\ d_2(\omega)s_2(\omega, k) \end{bmatrix} \tag{13}$$

Then, the split spectra for the above separated signal spectra $U_n(\omega,k)$ are generated as in Equations (14) and (15):

$$\begin{bmatrix} v_{11}(\omega, k) \\ v_{12}(\omega, k) \end{bmatrix} = \begin{bmatrix} g_{11}(\omega)s_1(\omega, k) \\ g_{21}(\omega)s_1(\omega, k) \end{bmatrix} \tag{14}$$

$$\begin{bmatrix} v_{21}(\omega, k) \\ v_{22}(\omega, k) \end{bmatrix} = \begin{bmatrix} g_{12}(\omega)s_2(\omega, k) \\ g_{22}(\omega)s_2(\omega, k) \end{bmatrix} \tag{15}$$

which show that the split spectra at each node are expressed as the product of the spectrum $s_1(\omega,k)$ and the transfer function, or the product of the spectrum $s_2(\omega,k)$ and the transfer function. Note here that $g_{11}(\omega)$ is a transfer function from the sound source 11 to the first microphone 13, $g_{21}(\omega)$ is a transfer function from the sound source 11 to the second microphone 14, $g_{12}(\omega)$ is a transfer function from the sound source 12 to the first microphone 13, and $g_{22}(\omega)$ is a transfer function from the sound source 12 to the second microphone 14.

If there are both permutation and amplitude ambiguity, the separated signal spectra $U_n(\omega,k)$ are expressed as in Equation (16):

$$\begin{bmatrix} U_1(\omega, k) \\ U_2(\omega, k) \end{bmatrix} = \begin{bmatrix} d_1(\omega)s_2(\omega, k) \\ d_2(\omega)s_1(\omega, k) \end{bmatrix} \tag{16}$$

and the split spectra at the nodes 1 and 2 are generated as in Equations (17) and (18):

$$\begin{bmatrix} v_{11}(\omega, k) \\ v_{12}(\omega, k) \end{bmatrix} = \begin{bmatrix} g_{12}(\omega)s_2(\omega, k) \\ g_{22}(\omega)s_2(\omega, k) \end{bmatrix} \tag{17}$$

$$\begin{bmatrix} v_{21}(\omega, k) \\ v_{22}(\omega, k) \end{bmatrix} = \begin{bmatrix} g_{11}(\omega)s_1(\omega, k) \\ g_{21}(\omega)s_1(\omega, k) \end{bmatrix} \tag{18}$$

In the above, the spectrum $v_{11}(\omega,k)$ generated at the node 1 represents the signal spectrum $s_2(\omega,k)$ transmitted from the sound source 12 and observed at the first microphone 13, the spectrum $v_{12}(\omega,k)$ generated at the node 1 represents the signal spectrum $s_2(\omega,k)$ transmitted from the sound source 12 and observed at the second microphone 14, the spectrum $v_{21}(\omega,k)$ generated at the node 2 represents the signal spectrum $s_1(\omega,k)$ transmitted from the sound source 11 and observed at the first microphone 13, and the spectrum $v_{22}(\omega,k)$ generated at the node 2 represents the signal spectrum $s_1(\omega,k)$) transmitted from the sound source 11 and observed at the second microphone 14.

3. Third Step

Each of the four spectra $v_{11}(\omega,k)$, $v_{12}(\omega,k)$, $v_{21}(\omega,k)$ and $v_{22}(\omega,k)$ shown in FIG. 2 is determined uniquely with an exclusive combination of one sound source and one transmission path in spite, of permutation. Amplitude ambiguity remains in the separated signal spectra $U_n(\omega,k)$ as in Equations (13) and (16), but not in the split spectra as shown in Equations (14), (15), (17) and (18).

Figure 3:
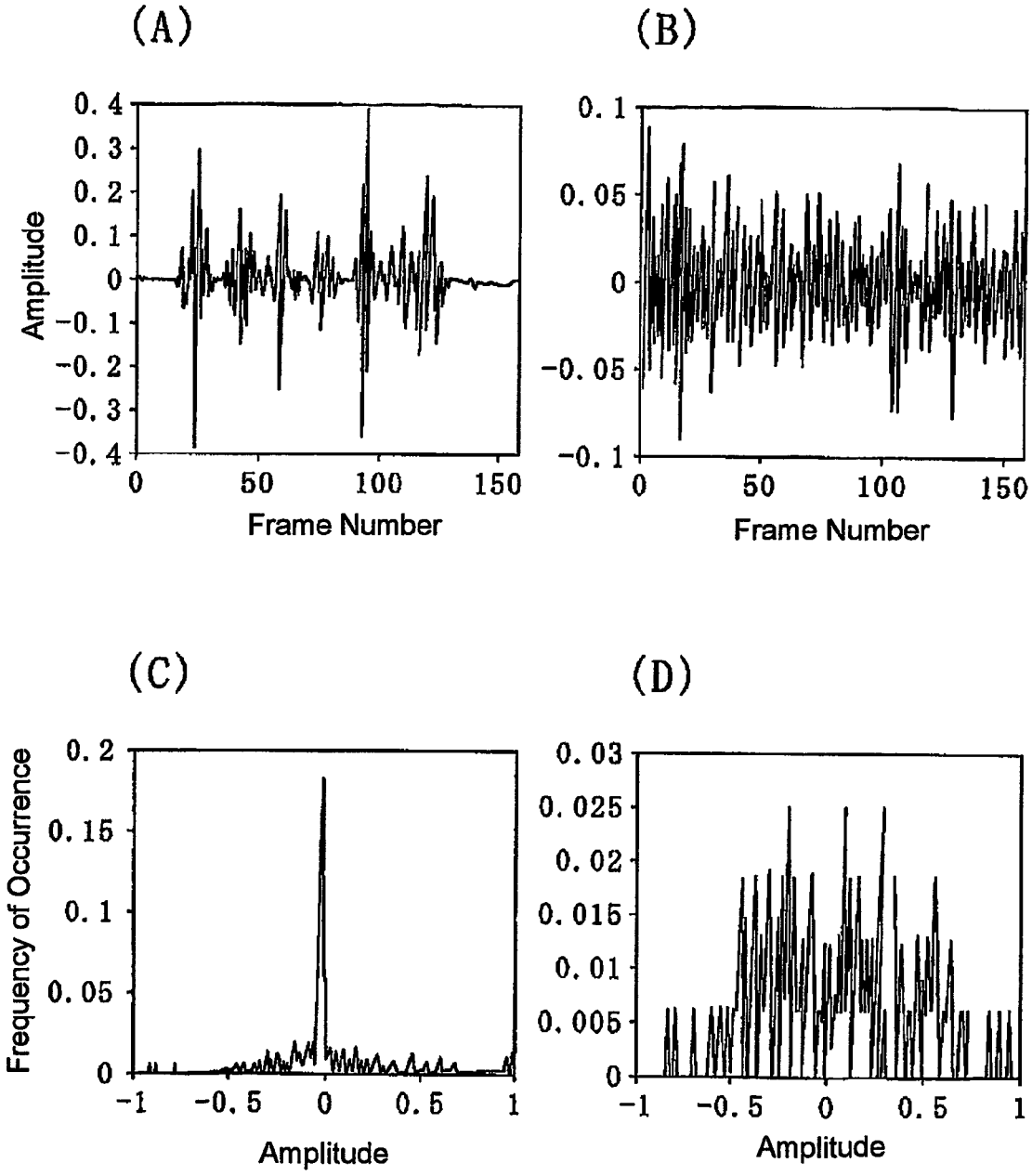
FIG. 3(A) is a graph showing the real part of a split spectrum series corresponding to the target speech.
FIG. 3(B) is a graph showing the real part of a split spectrum series corresponding to the noise.
FIG. 3(C) is a graph showing the amplitude distribution of the real part of the split spectrum series corresponding to the target speech.
FIG. 3(D) is a graph showing the amplitude distribution of the real part of the split spectrum series corresponding to the noise.

There is a well-known difference in statistical characteristics between speech and a noise in the time domain. That is, the shape of the amplitude distribution of a speech signal is close to that of the super Gaussian distribution, whereas the shape of the amplitude distribution of a noise signal has a relatively low kurtosis and a narrow base. FIGS. 3(A) and 3(B) show the real part of a split spectrum series corresponding to speech and the real part of a split spectrum series corresponding to a noise, respectively. FIGS. 3(C) and 3(D) show the shape of the amplitude distribution of the real part of the split spectrum series corresponding to the speech shown in FIG. 3(A) and the shape of the amplitude distribution of the real part of the split spectrum series corresponding to the noise shown in FIG. 3(B), respectively. As can be seen from FIGS. 3(C) and 3(D), the shape of the amplitude distribution for the speech is close to that of the super Gaussian, whereas the shape of the amplitude distribution for the noise has a relatively low kurtosis and a narrow base in the frame number domain as well. Therefore, by examining the amplitude distribution at each frequency for the real part of each of $v_{11}$ and $v_{22}$, the spectrum $v_{11}$ or $v_{22}$ that has a super Gaussian-like distribution is determined to be the estimated spectrum Z* corresponding to the speech, and the other spectrum that has a distribution with a relatively low kurtosis and a narrow base is determined to be the estimated spectrum Z corresponding to the noise. Hereinafter, an amplitude distribution of a spectrum refers to an amplitude distribution of a spectrum series over k at each ω.

The shape of the amplitude distribution of each of $v_{11}$ and $v_{22}$ may be evaluated by using the entropy E, which is defined in Equation (19) as follows:

$$E_{ij}(\omega) = -\sum_{n=1}^{N} p_{ij}(\omega, 1_n)\log p_{ij}(\omega, 1_n) \tag{19}$$

where $p_{ij}(\omega,1_n)$ (n=1, 2, . . . , N) is a probability, which is equivalent to $q_{ij}(\omega, 1_n)$ (n=1, 2, . . . , N) normalized as in the following Equation (20). Here, $1_n$ indicates the n-th interval when the amplitude distribution range is divided into N equal intervals for the real part of $v_{11}$ and $v_{22}$, and $q_{ij}(\omega, 1_n)$ is the frequency of occurrence within the n-th interval.

$$p_{ij}(\omega, 1_n) = q_{ij}(\omega, 1_n) \Big/ \sum_{n=1}^{N} q_{ij}(\omega, 1_n) \tag{20}$$

Thereafter, the difference between $E_{11}$ and $E_{22}$, i.e. $\Delta E = E_{11} - E_{22}$, is obtained, where $E_{11}$ is the entropy for $v_{11}$ and $E_{22}$ is the entropy for $v_{22}$. When ΔE is negative, it is judged that permutation is not occurring; thus, $v_{11}$ is assigned to the estimated spectrum Z* corresponding to the target speech, and $v_{22}$ is assigned to the estimated spectrum Z corresponding to the noise. For example, a conversion $[Z^*, Z]=[v_{11}, v_{22}]$ may be carried out for outputting the target speech from the channel 1.

On the other hand, when ΔE is positive, it is judged that permutation is occurring; thus, $v_{21}$ is assigned to the estimated spectrum Z* corresponding to the target speech, and $v_{12}$ is assigned to the estimated speck Z corresponding to the noise. For example, a conversion $[Z^*, Z]=[v_{21}, v_{12}]$ may be carried out for outputting the target speech from the channel 1.

Thereafter, the recovered spectrum group {y (ω, k)|k=0, 1, . . . , K−1} can be generated from all the estimated spectra Z* outputted from the channel 1. The recovered signal of the target speech y(t) is thus obtained by performing the inverse Fourier transform of the recovered spectrum group {y (ω, k)|k=0, 1, . . . , K−1} for each frame back to the time domain, and then taking the summation over all the frames as in Equation (21):

$$y(t) = \frac{1}{2\pi}\frac{1}{W(t)}\sum_k\sum_\omega e^{\sqrt{-1}\,\omega(t-k\tau)}y(\omega, k) \tag{21}$$

$$W(t) = \sum_{kw}(t-k\tau)$$

1. EXAMPLE 1

Experiments for recovering target speech were conducted in an office with 747 cm length, 628 cm width, 269 cm height, and about 400 msec reverberation time as well as in a conference room with the same volume and a different reverberation time of about 800 msec. Two microphones were placed 10 cm apart. A noise source was placed at a location 150 cm away from one microphone in a direction 10° outward with respect to a line originating from the microphone and normal to a line connecting the two microphones. Also a speaker was placed at a location 30 cm away from the other microphone in a direction 10° outward with respect to a line originating from the other microphone and normal to a line connecting the two microphones.

The collected data were discretized with 8000 Hz sampling frequency and 16 Bit resolution. The Fourier transform was performed with 32 msec frame length and 8 msec frame interval by use of the Hamming window for the window function. As for separation, by taking into account the frequency characteristics of the microphone (unidirectional capacitor microphone, OLYMPUS-ME12, frequency characteristics 200-5000 Hz), the FastICA algorithm was employed for the frequency range of 200-3500 Hz. (For the FastICA algorithm, see "*A Fast Fixed-Point Algorithm for Independent Component Analysis of Complex Valued Signals*" by E. Bingham and A. Hyvarinen, International Journal of Neural Systems, February 2000, Vol. 10, No. 1, pp. 1-8.) The initial weights were estimated by using random numbers in the range of (−1,1), iteration up to 1000 times, and a convergence condition CC>0.999999. The entropy E was obtained with N=200.

The noise source was a loudspeaker emitting the noise from a road during high speed vehicle driving and two types of a non-stationary noise ("classical" and "station") selected from NTT Noise Database (*Ambient Noise Database for Telephonometry*, NTT Advanced Technology Inc., Sep. 1, 1996). Noise levels of 70 dB and 80 dB at the center of the microphone were selected. At the target speech source, each of two speakers (one male and one female) spoke three different words, each word lasting about 3 seconds.

First, the spectra $v_{11}$ and $v_{22}$ obtained from the separated signal spectra $U_1$ and $U_2$ which had been obtained through the FastICA algorithm were visually inspected to see if they were separated well enough to enable us to judge if permutation occurred at each frequency. The judgment could not be made due to unsatisfactory separation at some low frequencies. When the noise level was 70 dB, the unsatisfactory separation rate was 0.9% in a non-reverberation room, 1.89% in the office, and 3.38% in the conference room. When the noise level was 80 dB, it was 2.3% in the non-reverberation room, 9.5% in the office, and 12.3% in the conference room. Thereafter, the frequencies at which unsatisfactory separation had occurred were removed, and the permutation correction capability was evaluated for each of the three methods: the method according to the present invention, the envelope method, and the locational information method ("*Permutation Correction and Speech Extraction Based on Split Spectra through FastICA*" by H. Gotanda, K. Nobu, T. Koya, K. Kaneda, T. Ishibashi, and N. Haratani, Proc. of International Symposium on Independent Component Analysis and Blind Signal Separation, Apr. 1, 2003, pp 379-384), the latter two of which are examples of conventional methods chosen for comparison.

Specifically, after applying each method, the resultant estimated spectra corresponding to the target speech were visually inspected to see if permutation had been corrected at each frequency, and a permutation correction rate defined as $F^+/(F^++F)$, where $F^+$ is the number of frequencies at which permutation is corrected and F is the number of frequencies at which permutation is not corrected, was obtained. The results are shown in Table 1.

TABLE 1

| Noise Level | Correction Method | Office | Conference Room |
|---|---|---|---|
| 70 dB | Envelope Method | 93.1% | 96.0% |
| | Locational Information Method | 94.2% | 57.7% |
| | Present Method | 99.9% | 99.9% |
| 80 dB | Envelope Method | 93.1% | 90.7% |
| | Locational Information Method | 88.3% | 55.0% |
| | Present Method | 99.8% | 99.8% |

As can be seen from Table 1, when the noise level is 70 dB, all the three methods show the permutation correction rates of greater than 90%, except the case of using the locational information method in the conference room with a long reverberation time of about 800 msec. In this case, the permutation correction rate is 57.7%, which is extremely low. In the present method, the permutation correction rates are greater than 99% for all the situations regardless of the reverberation level. For the case of the locational information method, the correction capability decreases as the reverberation time becomes longer. When the speaker is only 10 cm away form the microphone, the speech enters through the microphone clearly enough for this method to function even in a room with the reverberation time of about 400 msec. On the other hand, when the speaker and the microphone are 30 cm apart, the reverberation and the microphone location greatly affect the transfer function $g_{ij}(\omega)$, thereby lowering the correction capability in this method.

Slight differences in waveforms among the three methods were observed per a visual inspection on the waveforms with the permutation correction rates of greater than 90%. The recovered target speech according to the present method was the clearest per an auditory perception.

When the noise level is 80 dB, the present method shows the permutation correction rates of greater than 99% in all the situations, thereby demonstrating robustness against the noise and reverberation effects. Better waveforms and sounds were obtained by use of the present method than the envelop method.

2. EXAMPLE 2

Experiments for recovering target speech were conducted in a vehicle running at high speed (90-100 km/h) with the windows closed, the air conditioner (AC) on, and a rock music being emitted from the two front loudspeakers and two side loudspeakers. A microphone for receiving the target speech was placed in front of and 35 cm away from a speaker who was sitting at the passenger seat A microphone for receiving the noise was placed 15 cm away from the microphone for receiving the target speech in a direction toward the window or toward the center. Here, the noise level was 73 dB. The experimental conditions such as speakers, words, microphones, a separation algorithm, and a sampling frequency were the same as those in Example 1.

First, the spectra $v_{11}$ and $v_{22}$ obtained from the separated signal spectra $U_1$ and $U_2$ which had been obtained through the FastICA algorithm were visually inspected to see if they were separated well enough to enable us to judge if permutation occurred at each frequency. The rate of frequencies at which the separation was not satisfactory enough for the judgment amounted to as high as 20%. This was considered to be due to the environment wherein there were an engine noise, an AC noise, etc. in addition to the four loudspeakers emitting a rock music, together giving rise to more noise sources than the number of microphones, causing degradation of the separation capability. Thereafter, as in Example 1, the frequencies at which unsatisfactory separation had occurred were removed, and the permutation correction capability was evaluated for each of the three methods: the method according to the present invention, the envelope method, and the locational information method. The results are shown in Table 2.

TABLE 2

| | Envelope Method | Locational Information Method | Present Method |
|---|---|---|---|
| Microphone for Noise, toward Window | 86.6% | 80.4% | 99.4% |
| Microphone for Noise, toward Center | 89.6% | 76.6% | 99.4% |

As can be seen from Table 2, in the envelope method, the permutation correction rates are slightly less than 90%, and are different by a few percent depending on the location of the microphone for receiving the noise. On the other hand, in the present method, the permutation correction rates are greater than 99% regardless of the location of the microphone for receiving the noise. In the locational information method, the permutation correction rates are about 80%, which are lower than the results obtained by use of the present method or the envelope method. The present method is capable of correcting permutation problems without relying on the information on the sound sources' locations, thereby implying a wider application range.

While the present invention has been so described, the present invention is not limited to the aforesaid embodiment and can be modified variously without departing from the spirit and scope of the invention by those skilled in the art.

For example, in the present invention, the target speech is outputted from the first channel (node 1), but it is possible to output the target speech from the second channel (node 2) by performing the conversion of $[Z, Z^*]=[v_{22}, v_{11}]$ when $\Delta E$ is negative, and $[Z, Z^*]=[v_{12}, v_{21}]$ when $\Delta E$ is positive.

Further, the entropy $E_{12}$ may be used instead of $E_{11}$, and the entropy $E_{21}$ may be used instead of $E_{22}$.

Further, in the present invention, the entropy E is obtained based on the real part of the amplitude distribution of each of the spectra $v_{11}$, $v_{12}$, $v_{21}$, and $v_{22}$, it is possible to obtain the entropy E based on the imaginary part of the amplitude distribution.

Furthermore, the entropy E may be obtained based on the variable waveform of the absolute value of each of the spectra $v_{11}$, $v_{12}$, $v_{21}$, and $v_{22}$.

We claim:

1. A method for recovering target speech based on shapes of amplitude distributions of split spectra obtained by means of blind signal separation, the method comprising:

a first step of receiving target speech emitted from a sound source and a noise emitted from another sound source and forming mixed signals of the target speech and the noise at a first microphone and at a second microphone, the microphones being provided at separate locations;

a second step of performing the Fourier transform of the mixed signals from a time domain to a frequency domain, decomposing the mixed signals into two separated signals $U_1$ and $U_2$ by use of the Independent Component Analysis, and, based on transmission path characteristics of four different paths from the two sound sources to the first and second microphones, generating from the separated signal $U_1$ a pair of split spectra $v_{11}$ and $v_{12}$, which were received at the first and second microphones respectively, and from the separated signal $U_2$ another pair of split spectra $v_{21}$ and $v_{22}$, which were received at the first and second microphones respectively; and a third step of extracting estimated spectra Z* corresponding to the target speech and estimated spectra Z corresponding to the noise to generate a recovered spectrum group of the target speech from the estimated spectra Z*, wherein the split spectra $v_{11}$, $v_{12}$, $v_{21}$, and $v_{22}$ are analyzed by applying criteria based on entropy E representing a shape of an amplitude distribution of each of the split spectra $v_{11}$, $v_{12}$, $v_{21}$ and $v_{22}$, and performing the inverse Fourier transform of the recovered spectrum group from the frequency domain to the time domain to recover the target speech.

2. The method set forth in claim 1, wherein the entropy E is obtained by using the amplitude distribution of a real part of each of the split spectra $v_{11}$, $v_{12}$, $v_{21}$, and $v_{22}$.

3. The method set forth in claim 1, wherein the entropy is obtained by using a variable waveform of an absolute value of each of the split spectra $v_{11}$, $v_{12}$, $v_{21}$, and $v_{22}$.

4. The method set forth in claim 1, wherein the entropy E for the spectrum $v_{11}$, denoted as $E_{11}$, and the entropy E for the spectrum $v_{22}$, denoted as $E_{22}$, are obtained to calculate a difference $\Delta E=E_{11}-E_{22}$, and the criteria are given as:

(1) if the difference $\Delta E$ is negative, the split spectrum $v_{11}$ is extracted as the estimated spectrum Z*; and (2) if the difference $\Delta E$ is positive, the split spectrum $v_{21}$ is extracted as the estimated spectrum Z*.

5. The method set forth in claim 2, wherein the entropy E for the spectrum $v_{11}$, denoted as $E_{11}$, and the entropy E for the spectrum $v_{22}$, denoted as $E_{22}$, are obtained to calculate a difference $\Delta E=E_{11}-E_{22}$, and the criteria are given as:

(1) if the difference $\Delta E$ is negative, the split spectrum $v_{11}$ is extracted as the estimated spectrum Z*; and (2) if the difference $\Delta E$ is positive, the split spectrum $v_{21}$ is extracted as the estimated spectrum Z*.

* * * * *